US012571228B2

(12) United States Patent
Rome

(10) Patent No.: US 12,571,228 B2
(45) Date of Patent: Mar. 10, 2026

(54) RAFTER SUPPORT ASSEMBLY AND METHOD OF USING SAME

(71) Applicant: Gregg Rome, Baton Rouge, LA (US)

(72) Inventor: Gregg Rome, Baton Rouge, LA (US)

( * ) Notice: Subject to any disclaimer, the term of this patent is extended or adjusted under 35 U.S.C. 154(b) by 181 days.

(21) Appl. No.: 18/417,211

(22) Filed: Jan. 19, 2024

(65) Prior Publication Data

US 2024/0247515 A1 Jul. 25, 2024

Related U.S. Application Data

(60) Provisional application No. 63/480,772, filed on Jan. 20, 2023.

(51) Int. Cl.
*E04H 9/14* (2006.01)

(52) U.S. Cl.
CPC ..... *E04H 9/14* (2013.01)

(58) Field of Classification Search
CPC ..... E04H 9/14; E04H 9/029; E04H 9/0218
USPC ..... 52/90.1
See application file for complete search history.

(56) References Cited

U.S. PATENT DOCUMENTS 5,355,640 A * 10/1994 Frye ..... E04H 9/14 52/92.1
5,531,054 A * 7/1996 Ramirez ..... E04H 9/14 52/95
5,687,512 A * 11/1997 Spoozak ..... E04H 9/14 52/156
6,219,973 B1 * 4/2001 Lafferty ..... E04B 7/02 52/93.2
9,850,673 B1 * 12/2017 Hudlow ..... E04H 9/14
2001/0037611 A1 * 11/2001 Cornett, Sr. ..... E04H 9/14 52/223.13
2004/0134140 A1 * 7/2004 Gaddie ..... E04H 9/14 52/223.1
2021/0214943 A1 * 7/2021 Russell ..... E04B 1/215
2021/0310267 A1 * 10/2021 Espinosa ..... E04B 1/2604

* cited by examiner

*Primary Examiner* — Paola Agudelo
(74) *Attorney, Agent, or Firm* — Ted M. Anthony; Sarah B. Dupont

(57) ABSTRACT

A rafter support assembly and method of using same for use in locking down and securing an existing roof rafter to a frame and a foundation of an existing house or building structure. A rafter support assembly and method of using same comprising a rafter cable member and a wall cable member that are attachably connected to each other and to a foundation of an existing structure in order to create a tensile force, or tension, that maintains the stability and placement of an existing roof rafter.

3 Claims, 6 Drawing Sheets

RAFTER SUPPORT ASSEMBLY AND METHOD OF USING SAME

CROSS REFERENCES TO RELATED APPLICATION

Priority of U.S. PROVISIONAL PATENT APPLICATION Ser. No. 63/480,772, filed Jan. 20, 2023, incorporated herein by reference, is hereby claimed.

STATEMENTS AS TO THE RIGHTS TO THE INVENTION MADE UNDER FEDERALLY SPONSORED RESEARCH AND DEVELOPMENT

None.

BACKGROUND OF THE INVENTION

Field of the Invention

The present invention pertains to a rafter support assembly and method of using same for use in locking down and securing an existing roof rafter to a frame and a foundation of an existing house or building structure. More particularly, the present invention pertains to a rafter support assembly for use in being able to retrofit an existing house with a means to secure its roof to its foundation and place said house into compliance with hurricane strap building codes.

Brief Description of the Prior Art

Extreme winds, such as those generated by powerful hurricanes, can sometimes rip the truss of a roof off of the walls and frame of a house or building. This concern is especially important in areas that can be susceptible to strong hurricane-force winds. To reduce the risk from these winds, building codes in some areas require what is known as "hurricane straps." A hurricane strap building code is a set of requirements that must be met in order to prepare a structure for hurricanes by way of using physical strip or tie connections to secure a building from wind damage. These codes are typically put in place by state or local government authorities. Typically, these codes require that hurricane straps be installed on every rafter of every home. While it is not an issue for new construction homes to be built in compliance with the hurricane strap building codes, unfortunately, older homes generally do not meet the existing building code requirements.

As a result of these building codes, in certain areas, hurricane straps, or any other similar roof reinforcement means, must be installed on all new homes. These building codes may also require an existing home that is getting a roof replacement to be retrofit with these hurricane straps in order to be placed in compliance.

The conventional methods and means of reinforcing a connection between a roof truss and a wall frame of a house or building generally include various forms of hurricane ties, such as, for example, hurricane straps and hurricane clips. Hurricane straps are metal connectors that are used to reinforce the connection between the roof truss and the wall or frame of a house to minimize the risk of roof blow-off during extreme weather events. These are metal connectors with holes for fasteners, such as nails or screws. Roofers use hurricane ties to reinforce the connection between the roof truss and the wall plate. Typically, hurricane ties are stainless steel or galvanized steel, as both are strong and will not rust.

Hurricane ties work by creating a more direct load path from the roof to the foundation of the home. The tie provides more resistance against uplift forces that can pull the roof truss away from the wall. The number of nails in the clip does make a difference as to how effective the clip is.

There are several different shapes of conventional hurricane straps for trusses. Roofers may use different shapes for different roof trusses. Some examples of different types of hurricane straps for rafters include the following:

- Twist ties, which are shorter than many other types of ties, and they have a twist.
- Hurricane clips, which have a gap in the top for the rafter to run through.
- Hurricane straps, which are long, thin pieces of metal, hurricane straps are a straightforward way to connect the wall plate and the rafter.
- Twist straps, which are longer than the twist ties mentioned previously and come pre-twisted to attach to the rafter and the wall plate.
- Hurricane gusset angle, which are mainly used for gable ends, these ties sit on the wall plate and tuck against the rafter.
- Saddle ties, which unlike hurricane straps, come preformed to wrap around the rafter.

While there are multiple methods and means of securing a roof by the roof trusses and the wall plates, these conventional methods are mostly used in new construction houses and buildings. These methods are difficult to accommodate and retrofit into an existing house or building. Moreover, none of the current methods of securing a roof utilize a direct attachment means to the foundation of the building, providing for an additional strength, tension force, and support for the roof and for the wall frame, as well.

As such, the present invention pertains to a method and assembly that enables an older existing house or building to become compliant with the hurricane strap building code that requires a hurricane strap for every roof rafter in a way that is cost effective and less intrusive than replacing an entire roof structure.

SUMMARY OF THE INVENTION

The present invention pertains to a rafter support assembly and method of being able to place an existing house in compliance with new and existing hurricane strap building codes. The purpose of the present invention is to secure together the existing roof rafters to act as one unit. A rafter cable that is used to secure and tie the rafters together is then connected via a downward wall cable through a top plate of a wall framing member to the foundation providing a strong connection from the rafters all the way to the building foundation. The rafter support assembly of the present invention and method of using same will achieve a stronger or equal to connection as if the house were to have been built with hurricane straps for every rafter but in a far less intrusive manner. The rafter cable and wall cable system that are coordinating together through the rafters to the slab acting in compression will reduce the exterior wall movement as well.

The rafter support assembly of the present invention requires minimal interior wall demolition (sheetrock removal) of the house in order to gain access to the top plate and baseplate of the exterior wall frame in order to be installed. The present invention also requires access to an attic space and to be able to get within approximately eighteen inches (18") of an exterior wall. The present invention can be slightly modified, as needed depending on each particular housing structure, and can be applied to both a house on a slab or an elevated house.

In a preferred embodiment, the rafter support assembly comprises at least one rafter cable, wherein said rafter cable is attachably connected and secured through every single individual rafter member within a house roofing structure. Additionally, said rafter support assembly comprises at least one wall cable, wherein said wall cable is attachably connected to said rafter cable in a substantially downward perpendicular manner on a first end of said wall cable and is attachably connected to either an exterior floor beam or a concrete slab on a second end of said wall cable, depending on the type of foundation in the house. As such, said wall cable secures said rafter cable to a ground surface of the house.

In a preferred embodiment, said rafter support assembly of the present invention requires a few different steps when being applied to an elevated house than when being applied to a house on slab. For an elevated house, the rafter support assembly of the present invention comprises removing the interior face of an exterior wall on each interior anchor point of the house. At each of said determined anchor points, an installer would drill through both a bottom plate member of a wall frame member and an exterior floor beam member. An eyebolt would then be installed through said exterior floor beam and said bottom plate member, and said eyebolt would then be secured with a nut and a washer on an exterior surface.

Next, the installer would drill a hole, forming a bore, through each individual roof rafter member for said rafter cable to be run through. It is to be noted that while typically this would be done approximately eighteen inches (18") from a top plate member of said wall frame member, and in a top one-third portion of said roof rafter members around an entire perimeter of a roof of the house, the particular placement and location of the bores in the roof rafter members would be dependent on the size and structure of the particular building and roof. For example, some low-pitched roofs might not be able to get within approximately eighteen inches (18") of said top plate member of said wall frame member, while some high-pitched roofs could be able to get substantially closer to said top plate member of said wall frame member.

A button stop is then inserted into each drilled hole or bore in order to act as a sleeve for said rafter cable to run through. Said button stop, or sleeve, can be manufactured in a variety of different metal materials, including, but not limited to, aluminum, steel, copper, etc., or any other similar material exhibiting like characteristics. Said rafter cable would then be run through each aluminum sleeve within each bore on each roof rafter member around the entire perimeter of the building. The rafter cable would then be connected either to itself or to an additional rafter cable by way of at least one jaw and jaw turnbuckle, or any other similar attachment means, which would be tightened to apply a tension force to said rafter cable.

Next, the installer would drill a hole, forming a bore, through the top plate member of the wall frame member in multiple locations throughout the perimeter of the house. The wall cable member would be attachably connected to said rafter cable member, wherein said wall cable member would then be extended downward through said bores of said top plate member. Said wall cable member would then be attachably connected to said eyebolts by way of a jaw and jaw turnbuckle, which would be tightened to apply a tension force to said wall cable. All of these steps would be repeated at each determined connection point. It is to be noted that the number of downward wall cable members are dependent on the footprint of the housing structure and the size of the housing structure. For example, the smaller the housing structure, the fewer number of wall cable members that will be needed, and vice versa.

As such, the downward tensile force that is being applied on the roof rafter members by way of said wall cable and said roof cable will prevent said roof rafter members from lifting up or becoming loose during high wind events, and thus, will also reduce any wall movement.

In a preferred embodiment, the rafter support assembly of the present invention can be applied to homes on slab with the modification of the eyebolt being drilled and epoxied into the slab. For a house on slab, instead of drilling a hole through a bottom plate member of wall frame member and an exterior floor beam, the installer would either drill an eyebolt directly through said bottom plate member into the slab and then layer an epoxy resin, or any other similar material exhibiting like characteristics, to secure said eyebolt, or the installer could utilize an existing slab anchor bolt within the slab and utilize an eye-nut instead of an eyebolt with epoxy. This would create the connection point for the wall cable to secure to the slab of the house.

In an alternate embodiment, the rafter support assembly of the present invention can also be installed and utilized in the same manner on a top portion of said roof rafter members in order to create a compression force between said roof rafter members and a roof ridge beam. The downward wall cable that is run to the foundation in the preferred embodiment of the present invention, as discussed hereinabove, is not utilized in the alternate embodiment for the rafter collar tie application. A rafter collar tie is a tension tie located in the upper third of opposing gable rafters that are intended to resist rafter separation from the roof ridge beam during periods of unbalanced loads, such as that caused by wind uplift. As such, the alternate embodiment would be utilized in lieu of or to replace the use of conventional rafter collar ties.

It is to be that noted that while the alternate embodiment would typically be installed within approximately three feet (3') of a roof ridge beam, the particular placement would depend on the pitch of the roof for the particular building or structure at issue.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
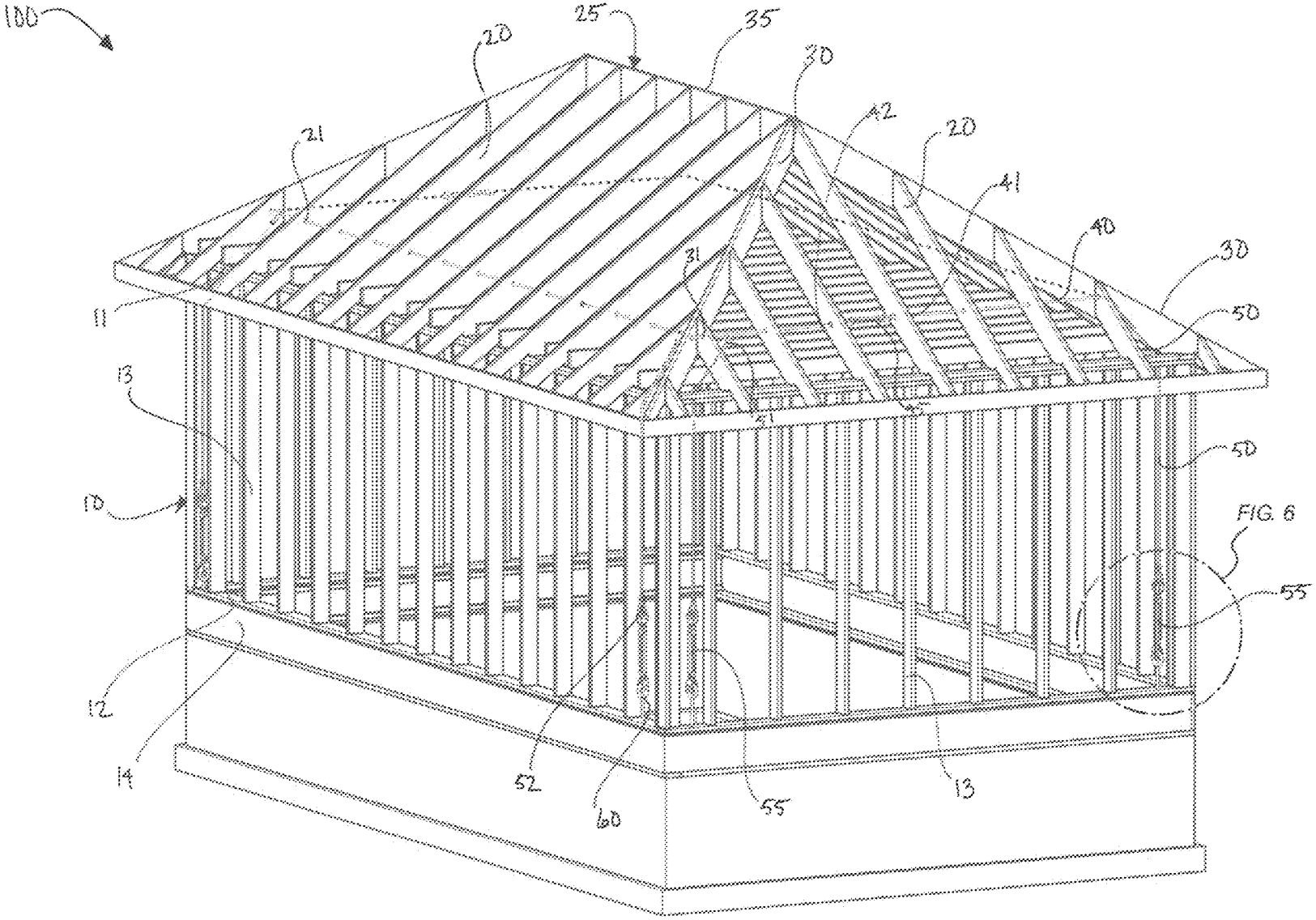
FIG. 1 depicts a side perspective view of a preferred embodiment of a rafter support assembly of the present invention utilized in a housing structure that is built on a concrete slab.

Referring to the drawings, a preferred embodiment of a rafter support assembly 100 of the present invention can be utilized in a housing or building structure that is built on a concrete slab or in a housing or building structure that is elevated. Regardless of the type of foundation that the building is built on, the way in which rafter support assembly 100 is secured within a roof frame 25 is the same.

Figure 3:
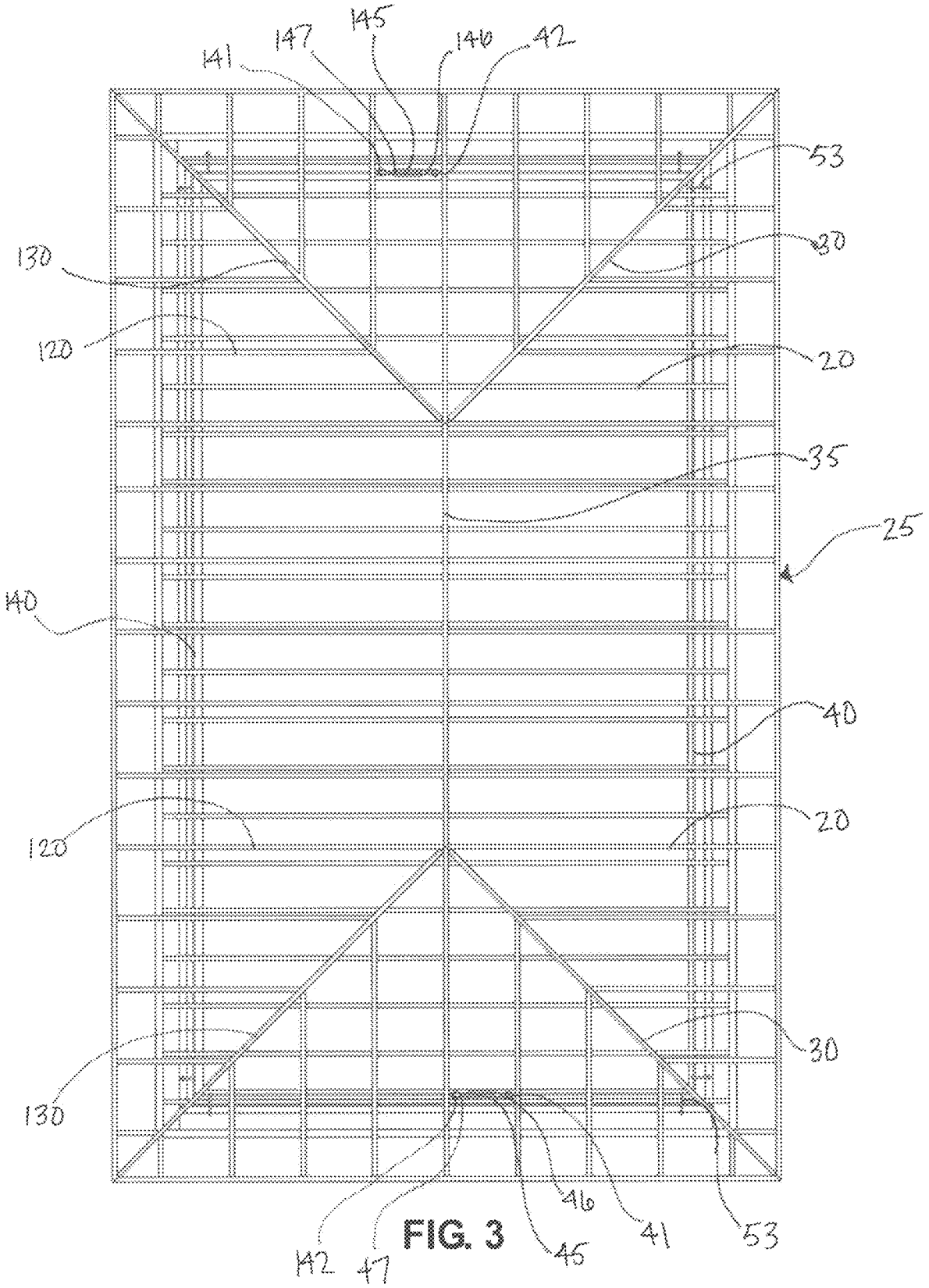
FIG. 3 depicts an aerial view of a preferred embodiment of a rafter support assembly of the present invention.

FIG. 3 depicts an aerial view of a preferred embodiment of rafter support assembly 100 of the present invention. Depending on the size and shape of the building, rafter support assembly 100 generally comprises at least one rafter cable member 40 having a first end 41 and a second end 42, wherein rafter cable member 40 is run through each roof rafter member 20 and hip rafter member 30 within a roof frame 25. It is to be noted that the number of rafter cable members 40 that are used in the rafter support assembly 100 of the present invention can vary depending on the size and structure of the house or building at issue.

If the building is relatively small, first end 41 of rafter cable member 40 is attachably connected to a first end 46 of a jaw and jaw turnbuckle 45. Second end 42 of rafter cable member 40 is then run through every roof rafter member 20 and hip rafter member 30, and then meets and attachably connects to a second end 47 of jaw and jaw turnbuckle 45 (although not depicted in FIG. 3). As a result, rafter cable member 40 is attachably secured to itself by way of jaw and jaw turnbuckle 45. Jaw and jaw turnbuckle 45 can then be tightened, as necessary, in order to create a tensile force, or tension. The tensile force is directed over the length of rafter cable member 40 and pulls energy equally on roof rafter members 20, thereby securing roof rafter members 20 in place.

If the building is relatively large or has a non-conventional shape, first end 41 of rafter cable member 40 is attachably connected to first end 46 of jaw and jaw turnbuckle 45. Second end 42 of rafter cable member 40 is then run through a plurality of roof rafter members 20 and a plurality of hip rafter members 30, and then meets and attachably connects to a first end 146 of a second jaw and jaw turnbuckle 145, as depicted in FIG. 3. A first end 141 of a second rafter cable member 140 is attachably connected to a second end 147 of jaw and jaw turnbuckle 145. A second end 142 of rafter cable member 140 is then run through the remaining roof rafter members 120 and hip rafter members 130, and then meets and attachably connects to second end 47 of jaw and jaw turnbuckle 45. As such, both jaw and jaw turnbuckle 45 and jaw and jaw turnbuckle 145 can be tightened, as necessary, in order to create a tensile force, or tension. The tensile force is directed over the length of rafter cable member 40 and rafter cable member 140, and thus, pulls energy equally on roof rafter members 20 and 120, thereby securing roof rafter members 20 and 120 in place.

Referring back to FIG. 1, FIG. 1 depicts a side perspective view of a preferred embodiment of rafter support assembly 100 of the present invention utilized in a housing structure that is on a slab 14. A housing or building structure generally comprises a wall frame 10, having a top plate 11, a bottom plate 12 and a plurality of wall members 13, wherein said top plate 11 is attachably connected to a roof frame 25. Roof frame 25 further comprises a plurality of roof rafter members 20 and a plurality of hip rafter members 30, wherein said hip rafter members 30 are generally located in each corner of said roof frame 25 and connect and join to a ridge rafter 35. As depicted in FIG. 1, bottom plate 12 of wall frame 20 is attachably connected to slab member 14.

Rafter support assembly 100 generally comprises rafter cable member 40 having first end 41 and second end 42, wherein rafter cable member 40 is run through a bore 21 located within all roof rafter members 20 and a bore 31 located within all hip rafter members 30 within roof frame 25. First end 41 of rafter cable member 40 is attachably connected to first end 46 of jaw and jaw turnbuckle 45. Second end 42 of rafter cable member 40 is then run through bores 21 of every roof rafter member 20 and bores 31 of every hip rafter member 30, and then meets and attachably connects to second end 47 of jaw and jaw turnbuckle 45. As a result, rafter cable member 40 is attachably secured to itself by way of jaw and jaw turnbuckle 45. Jaw and jaw turnbuckle 45 can then be tightened, as necessary, in order to create a tension force. The tension force is directed over the length of rafter cable member 40 and pulls energy equally on roof rafter members 20, thereby securing roof rafter members 20 in place.

Rafter support assembly 100 further comprises a plurality of wall cable members 50, wherein the particular number of wall cable members 50 that are needed and utilized depends on the size of the housing or building structure. Each wall cable member 50 comprises a first end 51 and a second end 52, wherein first end 51 of wall cable member 50 comprises a connection point 53 having a bore 54, wherein connection point 53 and bore 54 allow for rafter cable member 40 to be run through, thereby attachably connecting wall cable member 50 to rafter cable member 40. Wall cable member 50 is then run in a substantially downward perpendicular direction relative to rafter cable member 40. Second end 52 of wall cable member 50 is then attachably connected to a first end 56 of a jaw and jaw turnbuckle 55. A second end 57 of jaw and jaw turnbuckle 55 is attachably connected to a slab anchor bolt 60, which is drilled into said slab 14. As a result, jaw and jaw turnbuckle 55 can be tightened, as necessary, in order to create a downward tension force. This downward tension force is applied over the length of wall cable member 50 and pulls energy equally downward in order to further secure roof rafter members 20 towards slab 14.

In order to install rafter support assembly 100 into a house on a slab foundation, an installer would remove the interior face of exterior face from the exterior walls on each interior anchor point of the house. At each of said determined anchor points, an installer would either drill an eyebolt directly through a bore 18 located on said bottom plate member 12 into the slab 14 then layer an epoxy resin to secure said eyebolt (although not depicted in FIG. 1), or the installer could utilize an existing slab anchor bolt 60 within the slab 14 and utilize an eye-nut instead of an eyebolt with epoxy. This would create the connection point for the wall cable to secure to the slab of the house.

Next, the installer would drill a hole, forming a bore 21, through each individual roof rafter member 20 for said rafter cable 40 to be run through, approximately eighteen inches (18") from top plate member 11 of said wall frame member 10, and in a top one-third portion of said roof rafter members 20 around an entire perimeter of a roof of the house. A button stop 23 is then inserted into each bore 21 in order to act as a sleeve for said rafter cable 40 to run through. Said button stop, or sleeve 23, can be manufactured in a variety of different metal materials, including, but not limited to, aluminum, steel, copper, etc., or any other similar material exhibiting like characteristics. Said rafter cable 40 would then be run through each sleeve 23 within each bore 21 on each roof rafter member 20 around the entire perimeter of the building. The rafter cable 40 would be connected to either itself or an additional rafter cable member 140 by way of jaw and jaw turnbuckle 45, or any other similar attachment means, which would be tightened to apply a tension force to said rafter cable 40 and 140.

Although not depicted in FIG. 1, it is to be noted that the same steps and method as applied to rafter cable member 40 and jaw and jaw turnbuckle 45 would also be applied to an additional rafter cable 140 and an additional jaw and jaw turnbuckle 145, if necessary, depending on the size and shape of the building structure.

Next, the installer would drill a hole, forming a bore 17, through the top plate member 11 of the wall frame member 10 in multiple locations throughout the perimeter of the house. The wall cable member 50 would be attachably connected to said rafter cable member 40, wherein said wall cable member 50 would then be extended downward through said bores 17 of said top plate member 11. Said wall cable member 50 would then be attachably connected to said slab anchor bolts 60 by way of jaw and jaw turnbuckle 55, which would be tightened to apply a tension force to said wall cable 50. All of these steps would be repeated at each determined connection point depending on the number of wall cable members 50 that are needed.

As such, the downward tension force that is being applied on the roof rafter members by way of said wall cable 50 and said roof cable 40 will prevent said roof rafter members 20 and said hip rafter members 30 from lifting up or becoming loose during high wind events, and thus, will also reduce any wall movement.

Figure 2:
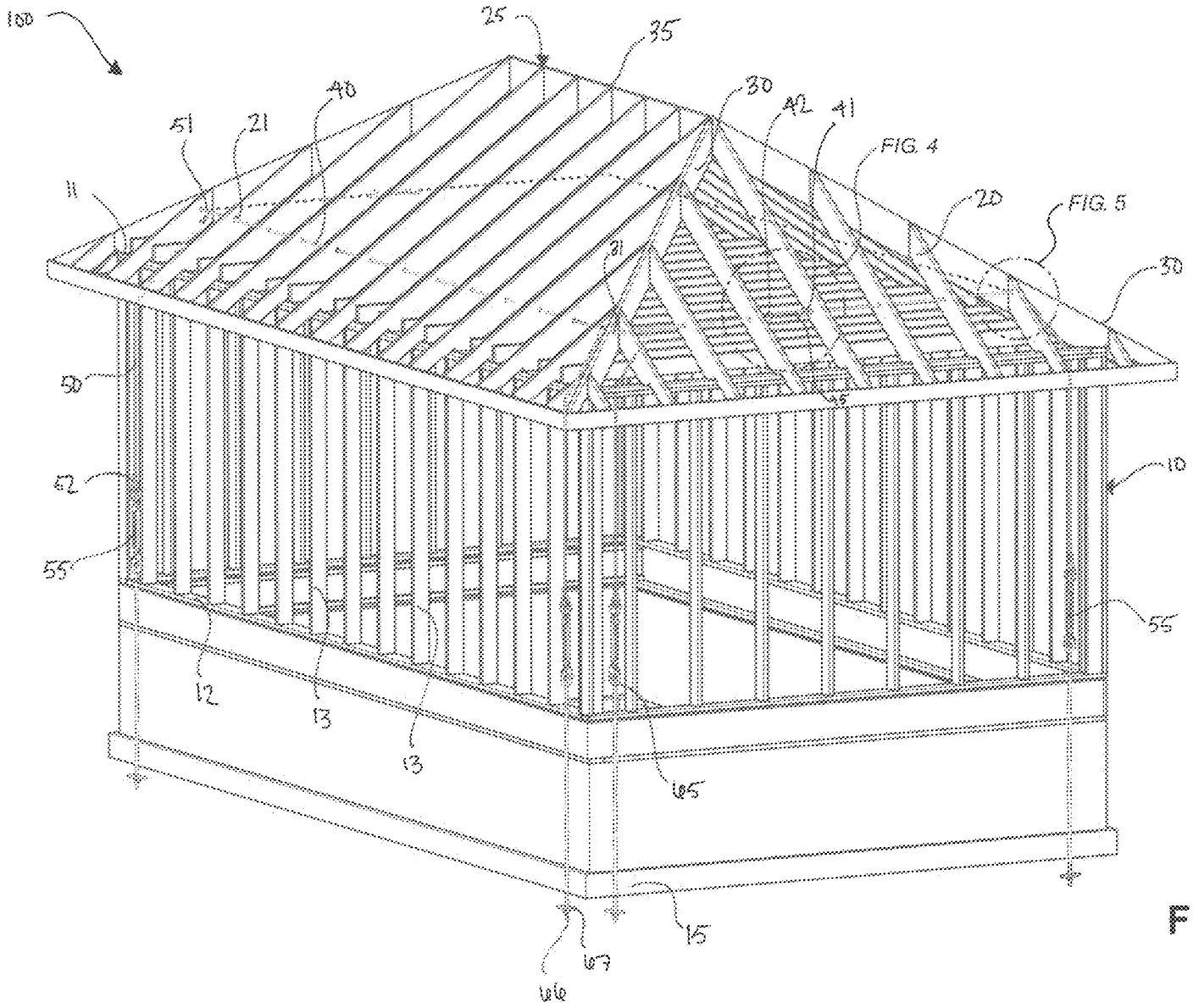
FIG. 2 depicts a side perspective view of a preferred embodiment of a rafter support assembly of the present invention utilized in a housing structure that is elevated.

FIG. 2 depicts a side perspective view of a preferred embodiment of rafter support assembly 100 of the present invention utilized in a housing structure that is elevated. Said housing or building structure generally comprises wall frame 10, having top plate 11, bottom plate 12 and wall members 13, wherein said top plate 11 is attachably connected to roof frame 25. Roof frame 25 further comprises roof rafter members 20 and hip rafter members 30, wherein said hip rafter members 30 are generally located in each corner of said roof frame 25. As depicted in FIG. 2, bottom plate 12 of wall frame 20 is attachably connected to an exterior floor beam member 15.

Rafter support assembly 100 generally comprises rafter cable member 40 having first end 41 and second end 42, wherein rafter cable member 40 is run through bore 21 located on all roof rafter members 20 and bore 31 located on all hip rafter members 30 within roof frame 25. First end 41 of rafter cable member 40 is attachably connected to first end 46 of jaw and jaw turnbuckle 45. Second end 42 of rafter cable member 40 is then run through bores 21 of every roof rafter member 20 and bores 31 of every hip rafter member 30, and then meets and attachably connects to second end 47 of jaw and jaw turnbuckle 45. As a result, rafter cable member 40 is attachably secured to itself by way of jaw and jaw turnbuckle 45. Jaw and jaw turnbuckle 45 can then be tightened, as necessary, in order to create a tension force. The tension force is directed over the length of rafter cable member 40 and pulls energy equally on roof rafter members 20, thereby securing roof rafter members 20 in place.

Rafter support assembly 100 further comprises a plurality of wall cable members 50, depending on the size of the housing or building structure. Each wall cable member 50 comprises first end 51 and second end 52, wherein first end 51 of wall cable member 50 comprises connection point 53 having bore 54, wherein connection point 53 and bore 54 allow for rafter cable member 40 to be run through, thereby attachably connecting wall cable member 50 to rafter cable member 40. Wall cable member 50 is then run in a substantially downward perpendicular direction relative to rafter cable member 40. Second end 52 of wall cable member 50 is then attachably connected to first end 56 of jaw and jaw turnbuckle 55. Second end 57 of jaw and jaw turnbuckle 55 is attachably connected to an eyebolt 65, which is drilled through bottom plate member 12 of wall frame 10 and exterior floor beam member 15. As a result, jaw and jaw turnbuckle 55 can be tightened, as necessary, in order to create a downward tension force. This downward tension force is applied over the length of wall cable member 50 and pulls energy equally downward in order to further secure roof rafter members 20 towards exterior floor beam 15.

In order to install rafter support assembly 100 into an elevated housing structure, an installer would remove the interior face of exterior from the exterior walls on each interior anchor point of the house. At each of said determined anchor points, an installer would drill through both bottom plate member 12 of wall frame member 10 and exterior floor beam member 15. An eyebolt 65 would then be installed through said exterior floor beam 15 and said bottom plate member 12, and said eyebolt 65 would then be secured with a nut 66 and a washer 67 on an exterior surface.

Next, the installer would drill a hole, forming bore 21, through each individual roof rafter member 20 for said rafter cable 40 to be run through, approximately eighteen inches (18") from top plate member 11 of said wall frame member 10, and in a top one-third portion of said roof rafter members 20 around an entire perimeter of a roof of the house. Button stop 23 is then inserted into each bore 21 in order to act as a sleeve for said rafter cable 40 to run through. Said button stop, or sleeve 23, can be manufactured in a variety of different metal materials, including, but not limited to, aluminum, steel, copper, etc., or any other similar material exhibiting like characteristics. Said rafter cable 40 would then be run through each sleeve 23 within each bore 21 on each roof rafter member 20 around the entire perimeter of the building. The rafter cable 40 would be connected to either itself or an additional rafter cable member 140 by way of jaw and jaw turnbuckle 45, or any other similar attachment means, which would be tightened to apply a tension force to said rafter cable 40 and 140.

Next, the installer would drill a hole, forming bore 17, through the top plate member 11 of the wall frame member 10 in multiple locations throughout the perimeter of the house. The wall cable member 50 would be attachably connected to said rafter cable member 40, wherein said wall cable member 50 would then be extended downward through said bores 17 of said top plate member 11. Said wall cable member 50 would then be attachably connected to said eyebolts 65 by way of jaw and jaw turnbuckle 55, which would be tightened to apply a tension force to said wall cable 50. All of these steps would be repeated at each determined connection point depending on the number of wall cable members 50 that are needed.

As such, the downward tension force that is being applied on the roof rafter members by way of said wall cable 50 and said roof cable 40 will prevent said roof rafter members 20 and said hip rafter members 30 from lifting up or becoming loose during high wind events, and thus, will also reduce any wall movement.

Figure 4:
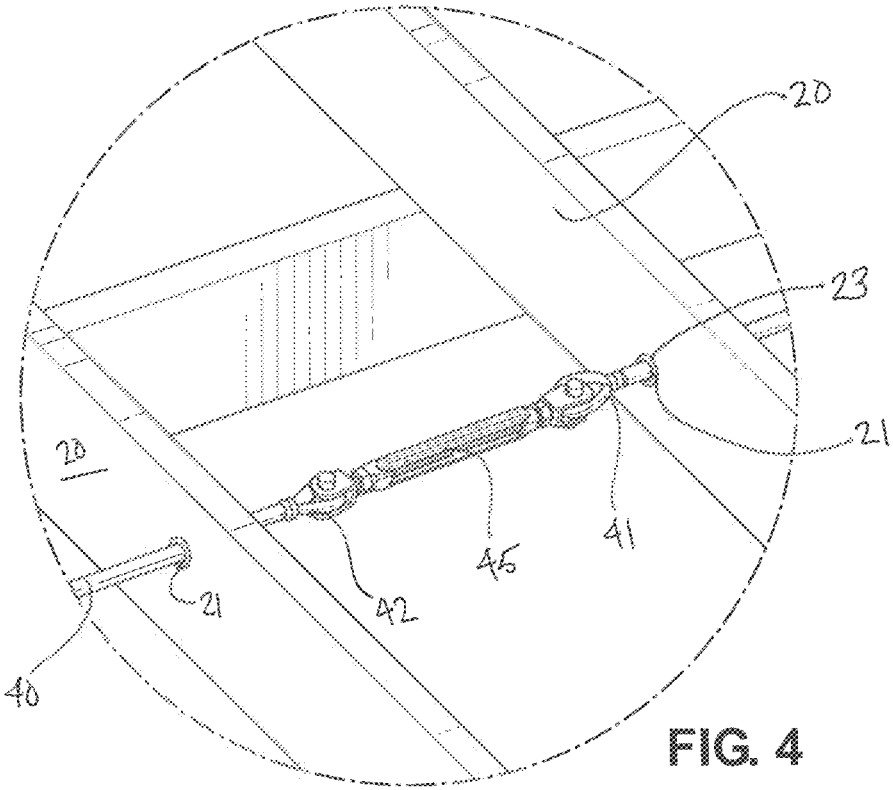
FIG. 4 depicts an enhanced view of a preferred embodiment of a jaw and a jaw turn buckle connection in a rafter support assembly of the present invention.

FIG. 4 depicts an enhanced view of a preferred embodiment of a jaw and a jaw turn buckle connection to rafter cable member 40 in rafter support assembly 100 of the present invention. Jaw and jaw turnbuckle 45 comprises first end 46 and second end 47. First end 46 of jaw and jaw turnbuckle 45 is attachably connected to first end 41 of rafter cable member 40. Second end 42 of rafter cable member 40 is then run through bore 21 with sleeve 23 of each roof rafter member 20 and hip rafter member 30 around the perimeter of roof frame member 25, thus meeting back up with and attachably connecting to either second end 47 of jaw and jaw turnbuckle 45 or attachably connecting to first end 146 of jaw and jaw turnbuckle 145, if the building structure is relatively large and needs more than one rafter cable and more than one jaw and jaw turnbuckle. Jaw and jaw turnbuckle 45 and 145 can then be tightened, as necessary, in order to create a tensile force applied equally through rafter cable member 40.

Figure 5:
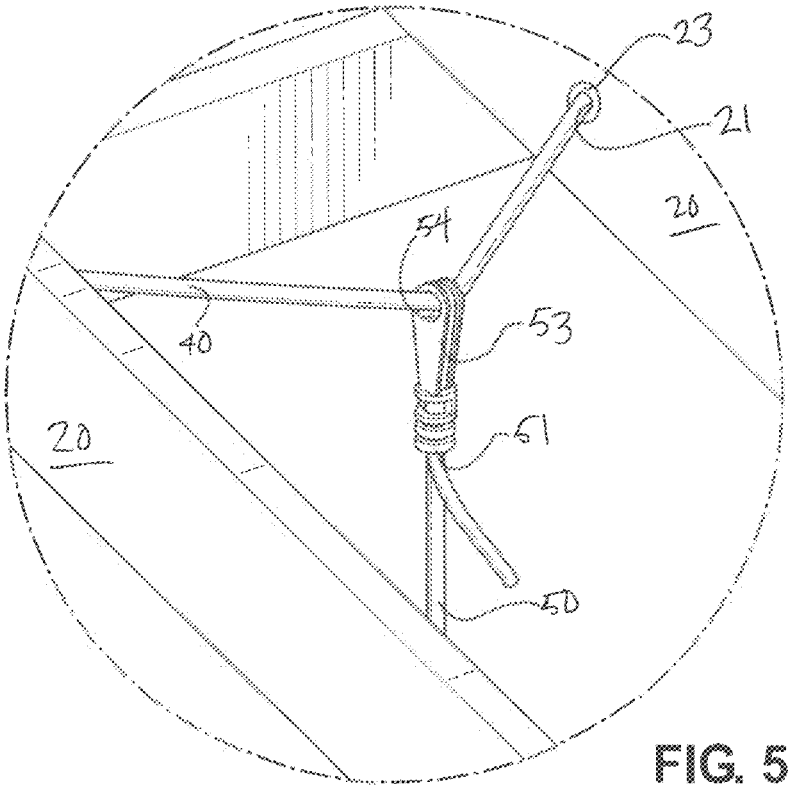
FIG. 5 depicts an enhanced view of a preferred embodiment of a top rafter cable connection to a wall cable in a rafter support assembly of the present invention.

FIG. 5 depicts an enhanced view of a preferred embodiment of wall cable connection to rafter cable member 40 in rafter support assembly 100 of the present invention. Wall cable member 50 comprises first end 51 and second end 52, wherein first end 51 of wall cable member 50 comprises connection point 53 having bore 54, wherein connection point 53 and bore 54 allow for rafter cable member 40 to be run through connection point 53, thereby attachably connecting wall cable member 50 to rafter cable member 40. Rafter support assembly 100 comprises a plurality of wall cable members 50, thereby a plurality of wall cable connections to rafter cable member 40.

Figure 6:
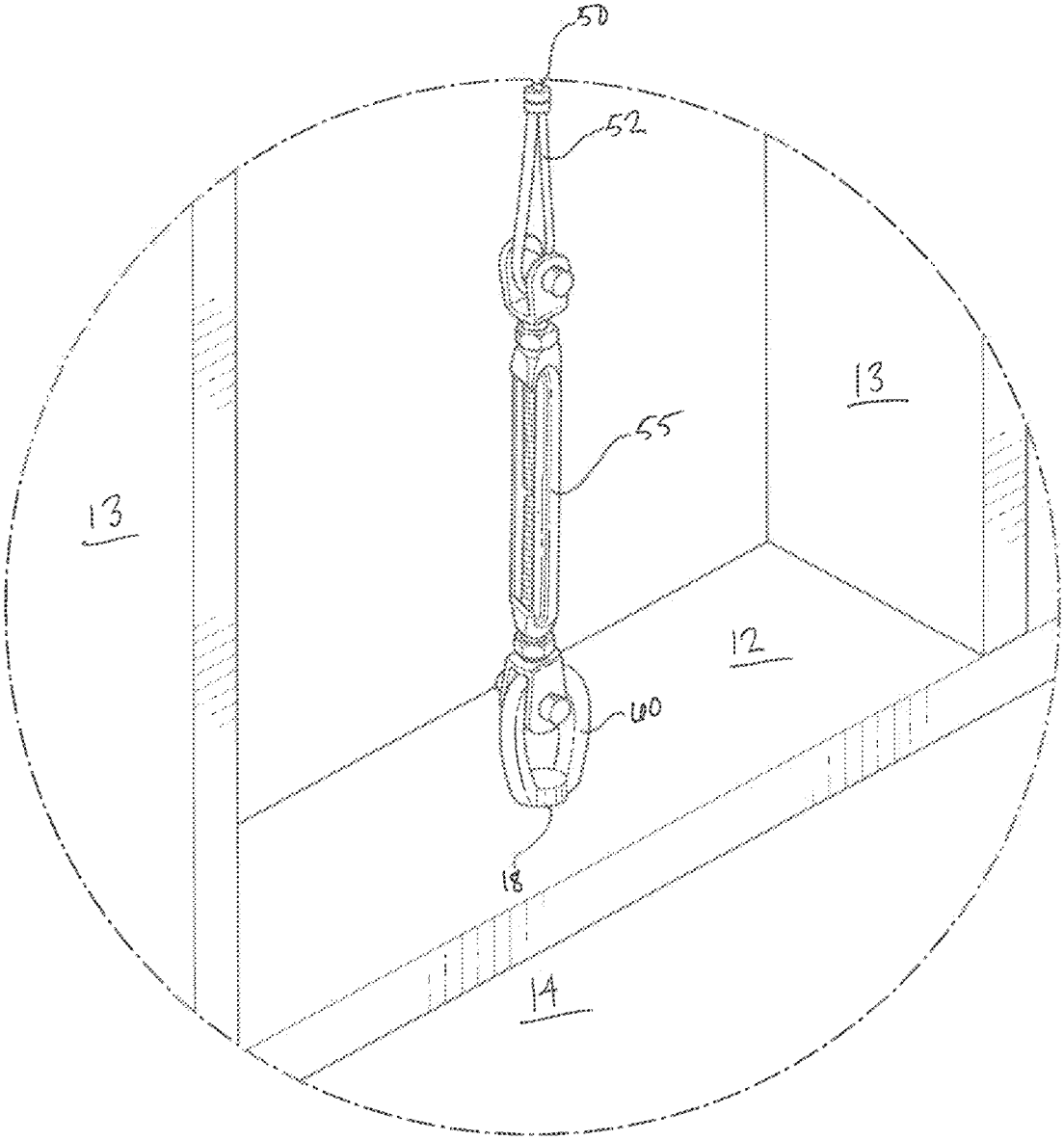
FIG. 6 depicts an enhanced view of a preferred embodiment of a jaw and jaw turn buckle connection to a slab anchor bolt in a rafter support assembly of the present invention.

FIG. 6 depicts an enhanced view of a preferred embodiment of a jaw and jaw turn buckle connection to wall cable member 50 and slab anchor bolt 60 in rafter support assembly 100 of the present invention. Wall cable member 50 comprises first end 51 and second end 52, wherein first end 51 of wall cable member 50 comprises a connection point 53 having bore 54, wherein connection point 53 and bore 54 allow for rafter cable member 40 to be run through, thereby attachably connecting wall cable member 50 to rafter cable member 40. Wall cable member 50 is then run in a substantially downward perpendicular direction relative to rafter cable member 40.

Second end 52 of wall cable member 50 is then attachably connected to first end 56 of jaw and jaw turnbuckle 55. Second end 57 of jaw and jaw turnbuckle 55 is attachably connected to slab anchor bolt 60, which is drilled into said slab 14. As a result, jaw and jaw turnbuckle 55 can be tightened, as necessary, in order to create a downward tensile force, or tension. This downward tensile force is applied over the length of wall cable member 50 and pulls energy equally downward in order to further secure roof rafter members 20 towards slab 14.

Figure 7:
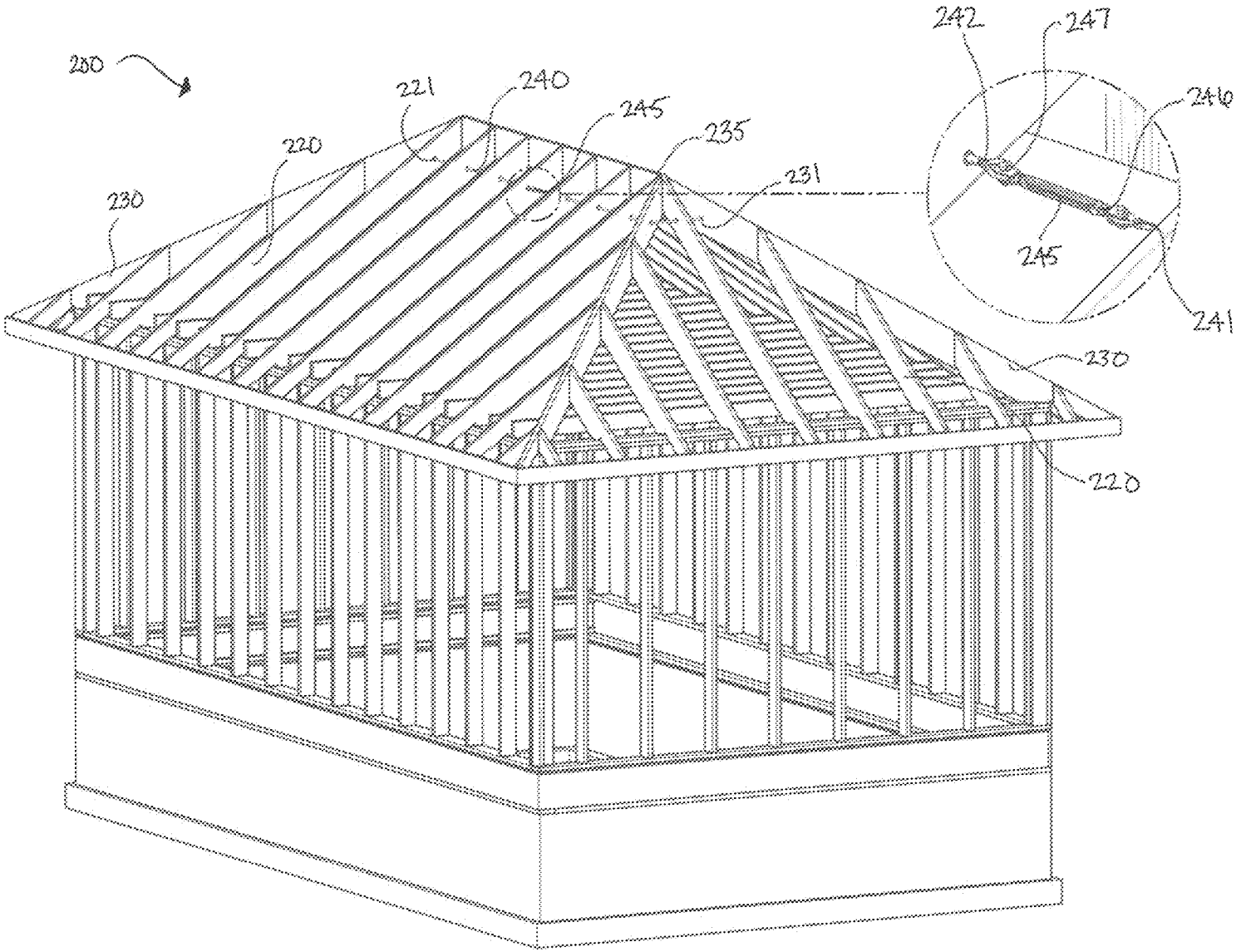
FIG. 7 depicts a side perspective view of an alternate embodiment of a rafter support assembly of the present invention utilizing a rafter collar tie cable connection.

In an alternate embodiment, FIG. 7 depicts a side perspective view of a rafter support assembly 200 comprising a rafter collar tie cable member 240, having a first end 241 and a second end 242, wherein rafter collar tie cable member 240 is run through a bore 221 located within all roof rafter members 220 and a bore 231 located within all hip rafter members 230 within roof frame 225. First end 241 of rafter collar tie cable member 240 is attachably connected to a first end 246 of a jaw and jaw turnbuckle 245. Second end 242 of rafter collar tie cable member 240 is then run through bores 221 of roof rafter members 220 and bores 231 of hip rafter members 230, and then meets and attachably connects to a second end 247 of jaw and jaw turnbuckle 245. As a result, rafter collar tie cable member 240 is attachably secured to itself by way of jaw and jaw turnbuckle 245. Jaw and jaw turnbuckle 245 can then be tightened, as necessary, in order to create a tensile force. The tensile force is directed over the length of rafter collar tie cable member 240 and pulls energy equally on roof rafter members 220, thereby securing roof rafter members 220 in place.

As such, as shown and illustrated in FIG. 7 in the alternate embodiment, the rafter support assembly 200 of the present invention can also be installed and utilized in the same manner on a top portion of said roof rafter members 220 in order to create a compression force between said roof rafter members 220 and a roof ridge beam 235.

Moreover, the downward wall cable that is run to the foundation in the preferred embodiment of the present invention, as discussed hereinabove and as depicted in FIGS. 1-6, is not utilized in the alternate embodiment for the rafter collar tie application.

It is to be that noted that while the alternate embodiment would typically be installed within approximately three feet (3') of a roof ridge beam, the particular placement would depend on the pitch of the roof for the particular building or structure at issue.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method of securing a roof frame to a building structure, comprising:

a. removing an interior face of an exterior wall on each interior anchor point of a building;

b. drilling a hole through both a bottom plate member of a wall frame member and an exterior floor beam member;

c. installing an eyebolt through said exterior floor beam member and said bottom plate member;

d. drilling a hole through a plurality of roof rafter members and a plurality of hip rafter members in order to run a rafter support apparatus through each roof rafter member and through each hip rafter member, wherein said rafter support apparatus comprises:

i. at least one rafter cable member, having a first end and a second end, wherein said first end of said rafter cable member is run through each of said rafter members and each of said hip rafter members;

ii. at least one rafter jaw and jaw turnbuckle, having a first end and a second end, wherein said rafter cable member is connected to said rafter jaw and jaw turnbuckle;

e. tightening said rafter jaw and jaw turnbuckle in order to create a tensile force directed over an entire length of said rafter cable member;

f. drilling a hole through a top plate member of said wall frame member in order to install a wall cable member; and g. tightening said wall cable member to create a tensile force directed over an entire length of said wall cable member.

2. The method of claim 1 wherein the rafter support apparatus further comprises at least one wall cable member, having a first end and a second end, wherein said first end of said wall cable member is connected to a rafter cable member and said second end of said wall cable member is connected to a ground surface.

3. The method of claim 2 wherein the rafter support apparatus further comprises at least one wall jaw and jaw turnbuckle, having a first end and a second end, wherein said wall cable member is connected to said wall jaw and jaw turnbuckle.

* * * * *